United States Patent [19]

Stellrecht

[11] 4,279,211

[45] Jul. 21, 1981

[54] CONTROLLABLY DRIVEN SEAMER

[75] Inventor: Ewald A. Stellrecht, Malvern, Pa.

[73] Assignee: Roll Former Corporation, King of Prussia, Pa.

[21] Appl. No.: 59,553

[22] Filed: Jul. 23, 1979

[51] Int. Cl.[3] ..... B21D 39/02

[52] U.S. Cl. ..... 113/55; 113/58

[58] Field of Search ..... 113/54 R, 55, 58; 29/243.5

[56] References Cited

U.S. PATENT DOCUMENTS

| | | | |
|---|---|---|---|
| 2,160,336 | 5/1939 | Maxfield | 113/55 |
| 3,487,799 | 1/1970 | Gronlund | 113/55 |
| 3,662,699 | 5/1972 | Horn et al. | 113/55 |
| 3,771,482 | 11/1973 | Thompson | 113/55 |
| 3,773,005 | 11/1973 | Day et al. | 113/55 |
| 3,797,430 | 3/1974 | Boudreau | 113/55 |

*Primary Examiner*—John McQuade

*Attorney, Agent, or Firm*—Hane, Roberts, Spiecens & Cohen

[57] ABSTRACT

A seamer for completing two preformed abutting sheets has a wheeled body for straddling by rolling over the sheets. Sets of die rollers and opposed backing rollers longitudinally aligned along the body are driven by a drive unit after being pivotably positioned in operative opposed relationship. A control mechanism including sensors extending from the body seeks the presence of the preformed sheets or an obstruction to control the operation of the drive unit.

14 Claims, 16 Drawing Figures

CONTROLLABLY DRIVEN SEAMER

BACKGROUND OF THE INVENTION

This invention pertains to seamers and more particularly to devices for completing seams in partially seamed abutting sheets.

In the laying of metal exterior building surfaces such as roofs it is common first to layer abutting sheets with partially formed seams. Then the partially formed seams are completed. Heretofore, the completion was accomplished by using sequentially different manual tools wherein each tool further bent the partially formed seam until finally the last tool finished the seam. It was then realized that such a technique was overly labor intensive and time consuming. Accordingly, attempts were made to integrate separate tools into a single motor driven device. Such a device did not operate well in practice. It was difficult to drive along a seam and had the tendency to ride up on the partial seams to create a deformed seamed area.

SUMMARY OF THE INVENTION

It is a general object of the invention to provide an improved apparatus for completing partially seamed abutting sheets, such apparatus operating more reliably than previously available apparatus.

Briefly, the invention contemplates apparatus of the kind described which has a wheeled body for straddlingly rolling over partially seamed abutting sheets. The body carries a set of die rollers longitudinally aligned along the body and a set of backing rollers operatively opposite different ones of the die rollers so that a die roller and a backing roller can cooperatively pinch the partially formed seam and drive means to drive at least some of the rollers. A control means extending from the body senses for the partially formed seam or an obstruction to control the operation of the drive means.

BRIEF DESCRIPTION OF THE DRAWING

Other objects, the features and advantages of the invention will be apparent from the following detailed description when read with the accompanying drawing which shows the presently preferred embodiment of the invention. In the drawing:

FIGS. 1A to 1E are enlarged cross-sectional views of the pans of FIG. 1;

DESCRIPTION OF THE PREFERRED EMBODIMENT

Figure 1:
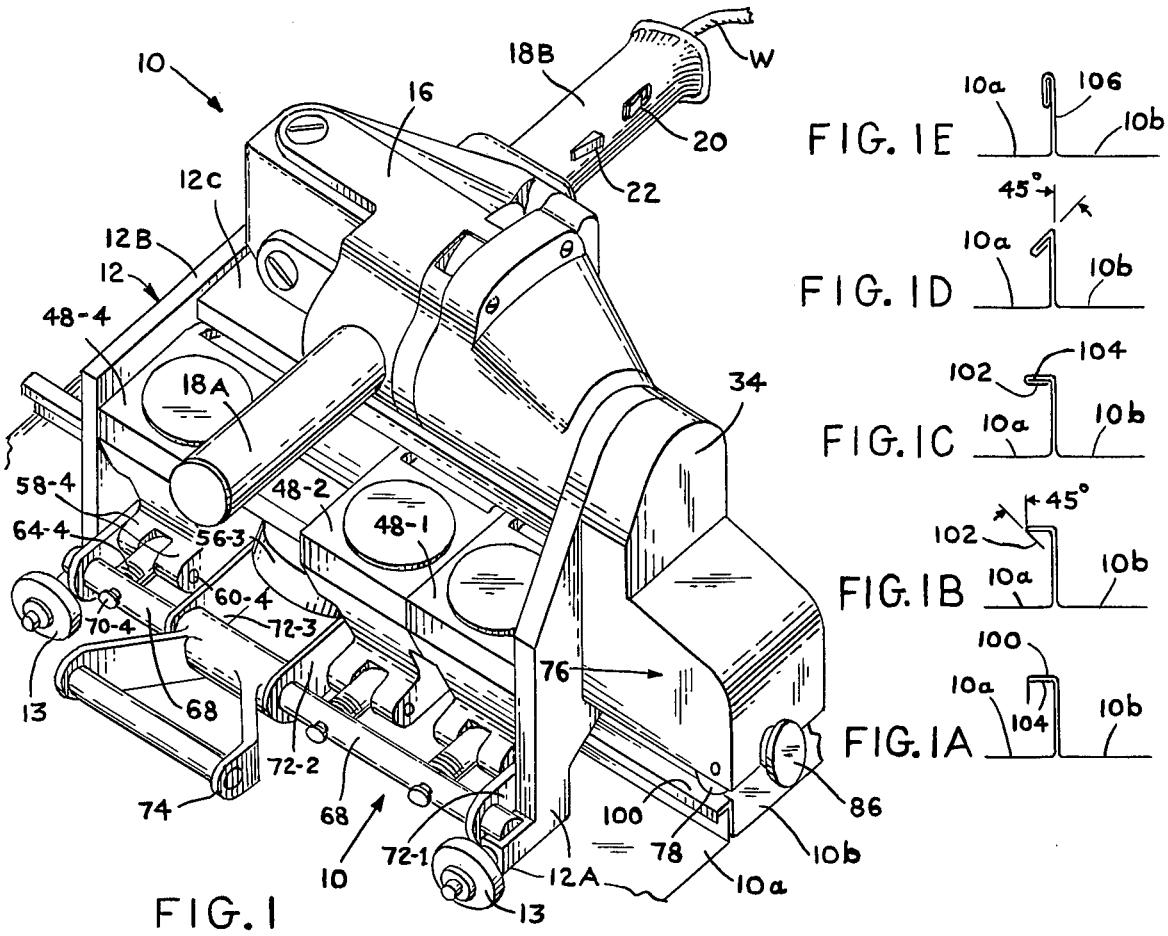
FIG. 1 shows a perspective view of the seamer in accordance with the invention straddling a partially formed seam of two abutting planes.

In FIG. 1 there is shown a seamer 10 operatively positioned on the partially seamed and abutting pans 10*a* and 10*b*. The pans are in abutting aligned relation on a roof or the like and are then seamed. (In particular, in FIG. 1A the pans 10A and 10B are shown preparatory to seam completion.) The seamer 10 is straddlingly positioned over the abutting pans and the seaming operation is commenced as hereinafter described. Progressively the pans are seamed according to the sequence of FIGS. 1B to 1E as the seamer 10 is driven longitudinally along the abutting seams.

The seamer 10 has a chassis composed of end members 12A and 12B, interconnected by longitudinal member 12C and pivot rod 14. The end members are provided with wheels 13 to permit the seamer to freely roll over the work site. Mounted on the member 12C is a motor housing 16 within which is a motor (not shown) and handles 18A and 18B. Handle 18B is provided with on-off switch 20 and jogging switch 22. The motor via its shaft 24 having a sprocket gear 26 drives chain 28 which in turn drives sprocket gear 30 at the end of drive shaft 32 within transmission housing 34. The ends of drive shaft 32 are mounted in end members 12A and 12B respectively by means of bearings 36A and 36B while the shaft is within gear box tube 33.

Equi-spaced along drive shaft 32 are worms 36-1, 36-2, 36-3 and 36-4 one per forming station. Extending along the left side of the shaft between the end members 12A and 12B are fixed housings 38-1 to 38-4. Associated with each housing 38-1 to 38-4 is a friction roller 40-1 to 40-4. A typical friction roller 40-1 (FIG. 4) within fixed housing 38-1 is connected via shaft 42-1 to worm gear 44-1 which engages worm 36-1. Friction roller 40-1 has a surface 41-1 of elastomeric cushioning such as URA-FLEX plastic. On the right side of shaft 32 are pivotable housings 48-1, 48-2 and 48-4. Associated with pivotable housings 48-1, 48-2 and 48-4 are die rollers 50-1, 50-2 and 50-4. A typical die roller 50-1 (FIG. 4) is connected via shaft 52-1 to worm gear 54-1 which engages worm 36-1.

Figure 6:
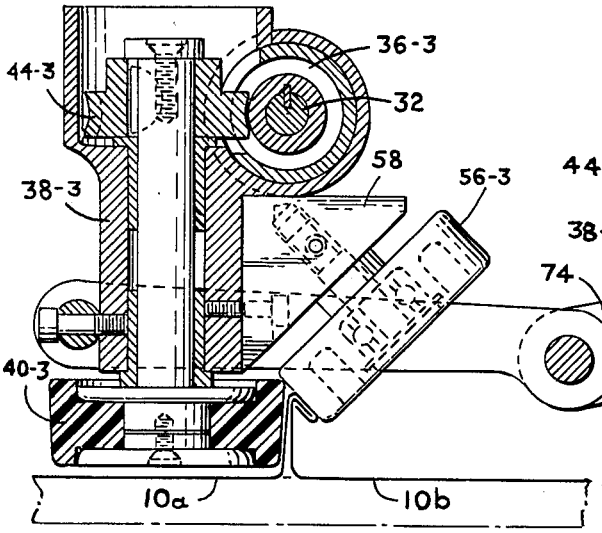
FIG. 6 is a sectional view along the line 6—6 of FIG. 2.
Figure 7:
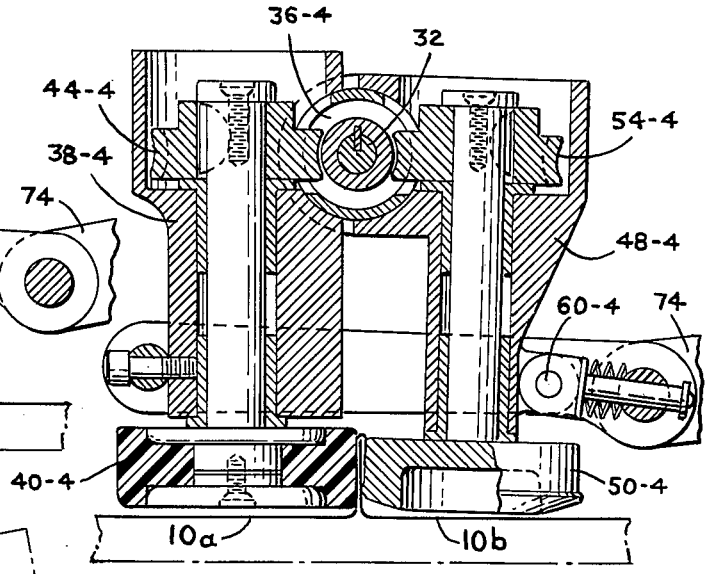
FIG. 7 is a sectional view along the line 7—7 of FIG. 2.

There are rotatably mounted from the fixed housings 38-1 to 38-3 respective cam followers 56-1 to 56-3. The cam followers associated with housings 38-1 and 38-2 are the same as the cam follower 56-1 of FIG. 4 and have axes orthogonal to their associated friction rollers. The cam follower 56-3 associated with the third station has a diameter the same as the die rollers and an axis of rotation which makes an angle of 45° with the axis of friction roller 40-3. As shown in FIG. 6 cam-follower 56-3 is mounted on housing 38-3 via block 58.

The pivotable housings 48-1, 48-2 and 48-4 are pivotably mounted to controllably rotate about the axis of drive shaft 32. A typical housing 48-4 shown in FIG. 8 has a portion 57-4 which slides about gear box tube 33. Fixed to the base of housing is a bifurcated bearing mount 58-4 carrying a pin 60-4 from which extends a rod 62-4 about which is disposed compression spring 64-4. The other end of rod 62 passes through common rod 68 and is fixed thereto by means of screw and washer means 70-4. Four pivot locking arms 72-1 to 4, connect pivot rod 14 to common rod 68. See also FIG. 1.

Figure 8:
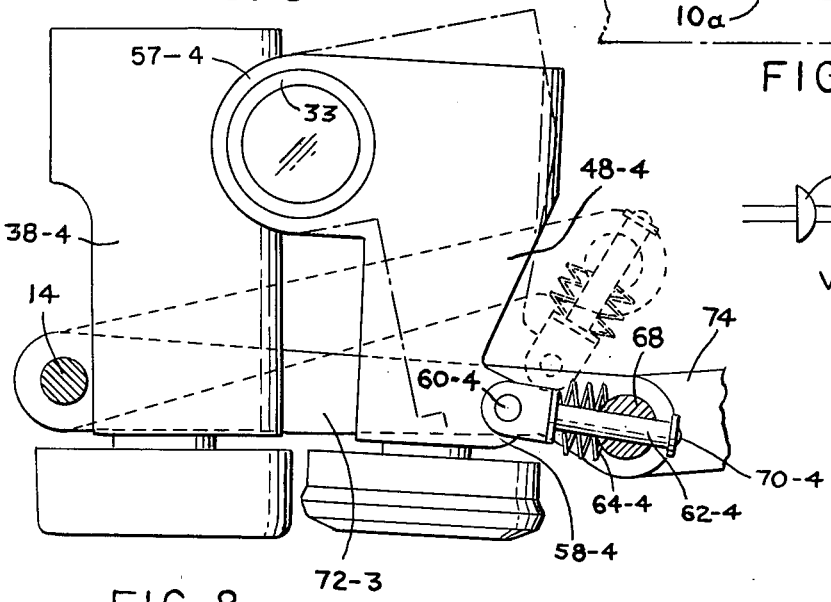
FIG. 8 is a schematic view depicting the locking action of the rollers.

When the handle 74 is raised the pivotable housings assume the position shown by the dotted lines in FIG. 8 and when the handle 74 is lowered the housings assume the solid line position. As long as rod 68 is vertically above rod 14 as seen in the figures rod 68 lifts up the housings to the open position; and when rod 68 is vertically below rod 14 as viewed in FIG. 8 the housings are urged closed by the springs 64-1, 2 and 4. In addition, springs 64-1, 2 and 4 provide cushioning for any material between the opposed rollers in the closed position.

Figure 2:
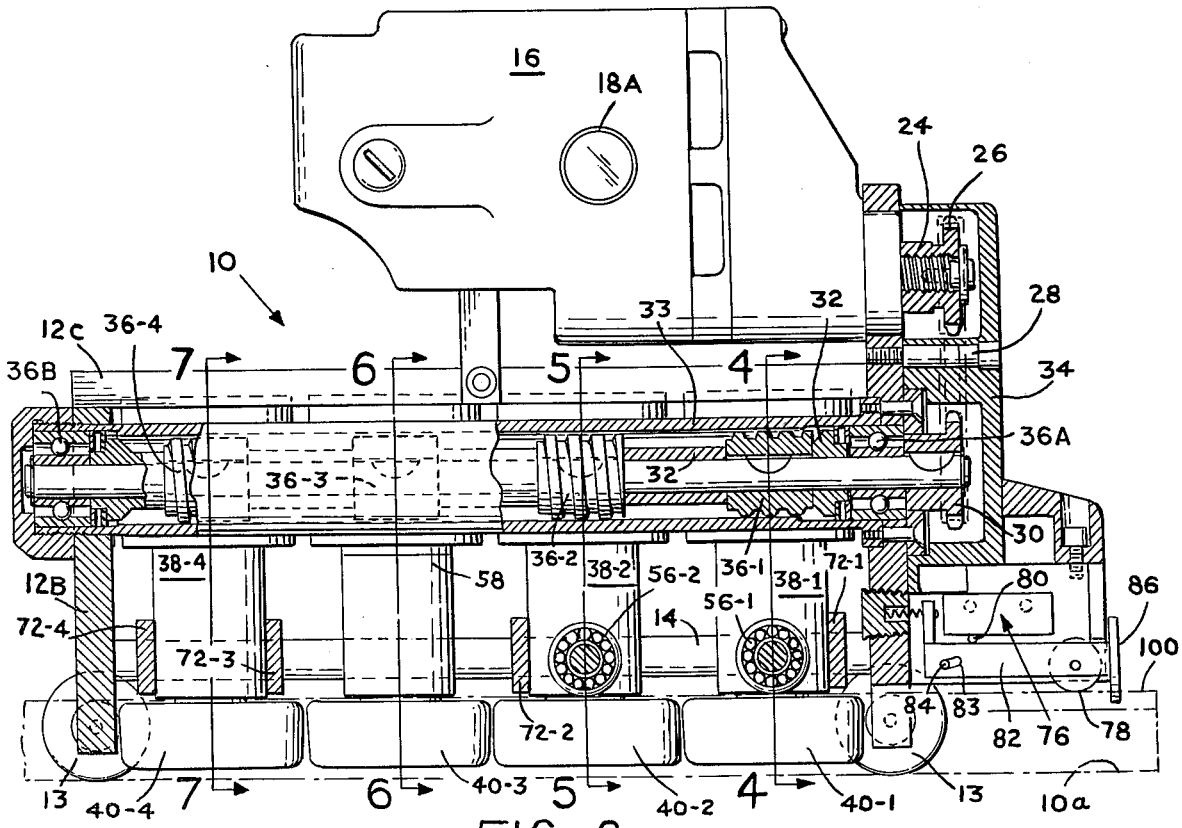
FIG. 2 is a partially cross sectioned view looking to the right from the vertically extending major longitudinal plane of the seamer of FIG. 1.
Figure 3:
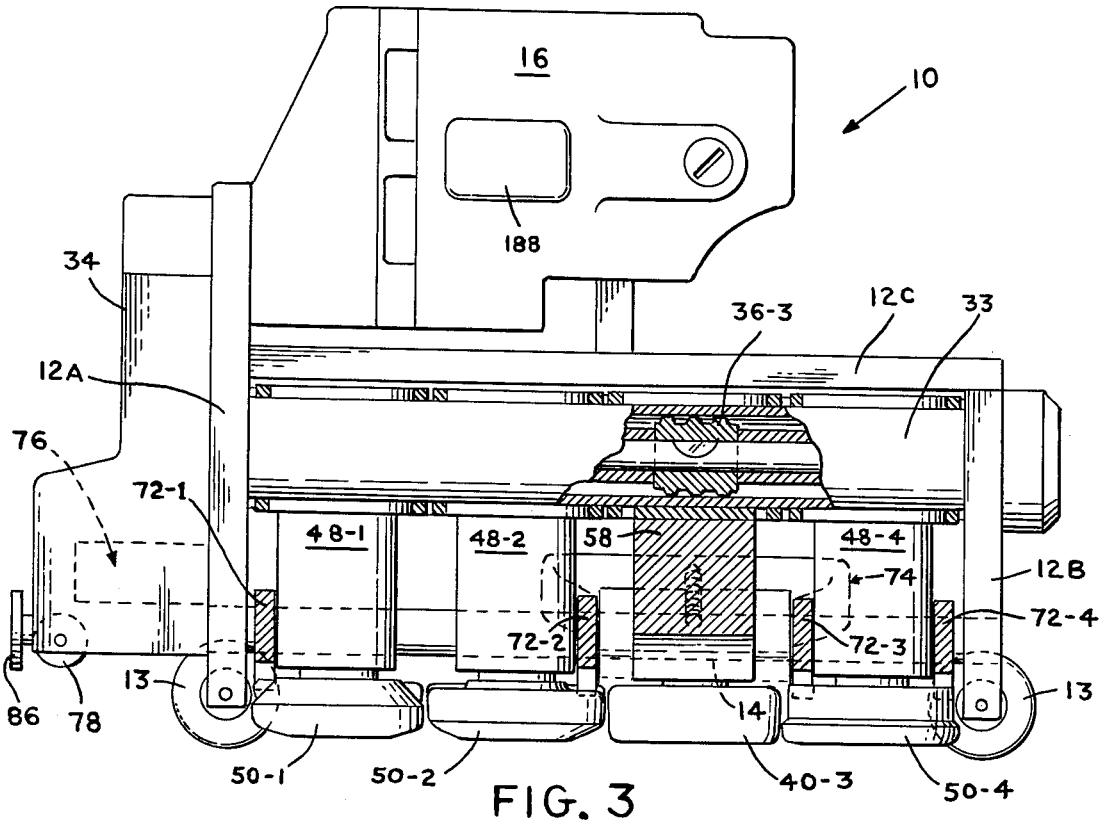
FIG. 3 is a cross sectional view looking to the left of said plane.

Extending forward from end member 12A and at the center of the seamer is normally open microswitch 76. See, in particular, FIG. 2. Switch 76 which is mounted on the chassis has a plunger 80 resting against spring-biased lever arm 82 pivotably mounted via slot 83 therein on shaft 84 fixed to the chassis. The free end of arm 82 carries roller wheel 78 which normally rides on top bend 100. Extending from the end of lever arm 82 is bumper 86.

Figure 9:
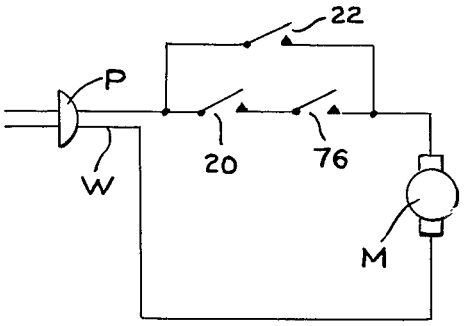
FIG. 9 is a schematic view of the electrical circuits in the apparatus.
Figure 10:
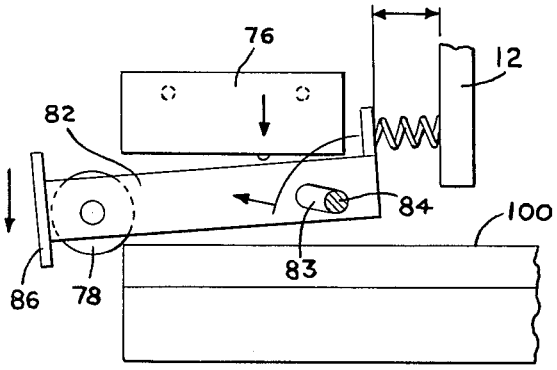
FIG. 10 is a schematic view of the control means in another position.
Figure 11:
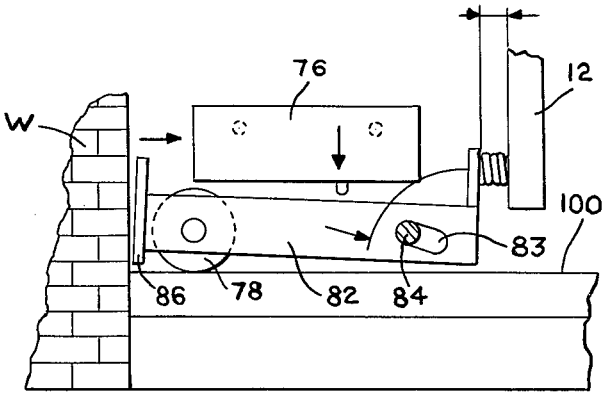
FIG. 11 is a schematic view of a control means utilizing a lever-arm actuated microswitch in one position.

The operation of the seamer 10 will now be described. The seamer 10 is placed as near to the beginning of the preformed pans as possible. The seamer 10 straddles the pans 10*a* and 10*b* as shown in FIG. 1. (Note however in FIG. 1 the seamer 10 is shown at the end of a seam run, not at the beginning). The handle 74 is in the raised position so that the roller sets are separated as in the dotted position of FIG. 8. The roller 78 of the microswitch 76 rests on the top bend 100 of pan 10*b*. See also FIG. 1. The handle 74 is then lowered. The seamer 10 will be hand guided along the top bend 100 using the switch 76 as a guide. By intermittently tapping the jogging switch 22 electricity is applied to motor M in spurts. See FIG. 9. Motor M causes the drive shaft 32 to rotate and drive the friction rollers and the die rollers. In this manner the seamer 10 is eased into position, after a length of seam equal to about the length of the seamer is completed, automatic operation can start by moving the on-off switch 20 to the closed position. See FIG. 9. As long as the roller 78 of microswitch 76 rests on top bend 100 the switch 76 is also transferred from the normally open to the normally closed position and motor M continuously receives power under control of microswitch 76. When the end of the seam is reached the microswitch opens stopping the motor. See FIG. 10. In particular, wheel 78 drops off the end of the seam and the arm 82 pivots counter clockwise removing pressure from the plunger of the microswitch which then shifts to its normally open position. In addition, during the seaming completing operation, if the seamer starts to ride up from the seam, the switch 76 opens and the motor stops with the seamer still locked on the seam. This action is similar to that described for FIG. 10. Finally, if the seamer hits a wall W, bumper 86 urges the arm 82 backward in the slot 84 in effect pivoting the arm 82 clockwise about the axle of roller 78 thus opening switch 84. Because of the automatic operation with ability to stop if "ride up" commences, it is possible to start the seamer by one man at one end of a run by a different man who then starts a new seaming operation.

Figure 4:
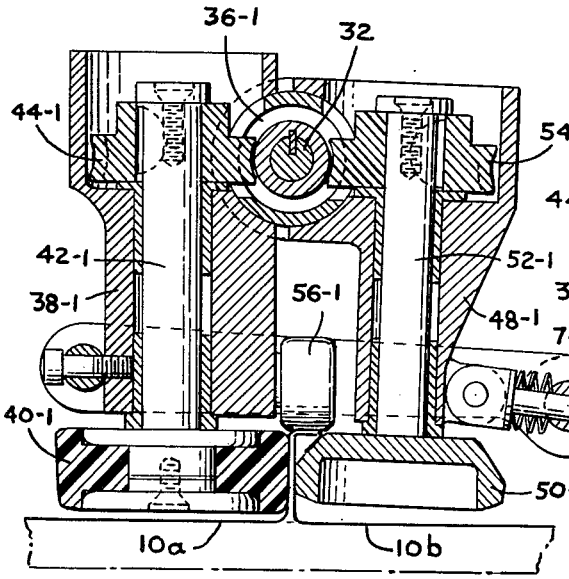
FIG. 4 is a sectional view along the line 4—4 of FIG. 2.
Figure 5:
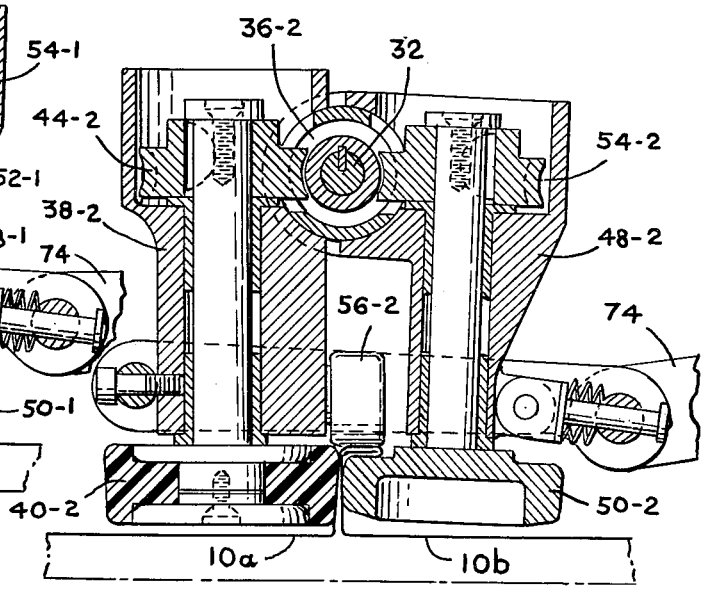
FIG. 5 is a sectional view along the line 5—5 of FIG. 2.

A careful study of FIGS. 1A to E and FIGS. 4, 5, 6 and 7 will teach how the seam is completed. Initially the preformed pan is shown in FIG. 1A before station 1 of seamer 10 arrives. Station 1 is best seen in FIG. 4. At station 1 the downwardly extending edge 102 of pan 10*b* is bent for a 90° angle to a 45° angle with respect to top bend 100 by die roller 50-1. Cam follower 56-1 prevents any upward movement of the bend. See also FIG. 1B. At station 2 (FIG. 5 and FIG. 1C) die roller 50-2 bends edge 102 horizontally flat against top bend 104 of pan 10*a*. Cam follower 56-2 holds the seam in place. At station 3 (FIG. 6 and FIG. 1D) cam follower 56-3 bends the bend 104 now covered by bend 100 and edge 102 to an angle of 45° with the vertical. At station 56-4 the bend of station 3 is finished by die roller 50-4 pressing the bent portion against the uprights 106 of the pan. See FIGS. 7 and 1E.

There has thus been shown an improved seam completing apparatus. In particular, the use of a microswitch provides reliable and safe operation of the seamer even in unattended operation. Furthermore, the use of elastomeric friction rollers opposite the die rollers gives area contact to the pan bends as opposed to linear contact. This enhances the tractive power of the seamer and therefore permits self starting.

While only one embodiment of the invention has been shown and described in detail there will now be obvious to those skilled in the art many modifications and variations satisfying many or all of the objects of the invention but not departing from the spirit thereof as defined by the appended claims.

What is claimed is:

1. Apparatus for completing the seams of two preformed abutting sheets, said apparatus comprising a body, a plurality of wheels on said body whereby said body can straddlingly roll over the preformed abutting sheets, a plurality of die rollers longitudinally aligned in said body, a plurality of backing rollers longitudinally aligned in said body, each of said backing rollers being operatively opposite a different one of said die rollers to form sets of die rollers and backing rollers whereby a backing roller and a die roller can cooperatively pinch the partially formed seam, pivotable mounting means on said body supporting said die rollers for movement towards and away from said backing rollers between operative closed and inoperative open positions, drive means for driving at least some of said rollers in rotation, and a control means extending from said body for sensing the presence of the partially formed seam to control the operation of said drive means also sensing obstructions in the path of said apparatus to deactivate the drive means, said control means comprising switch means operatively associated with said drive means for controlling the operation thereof, actuator means facing said switch means and including first sensor means for sensing the presence of a seam and second sensor means for sensing the presence of an obstruction, and means connecting said actuator means to said body for cooperation with said switch means to selectively control the operation of said drive means in response to the presence of a seam and an obstruction.

2. The apparatus of claim 1 wherein at least some of said backing rollers are covered with a cushioning material.

3. The apparatus of claim 1 wherein each of said die rollers has a differently contoured operating surface means for imparting a further bend in the partially seamed abutting sheets.

4. The apparatus of claim 1 wherein said mounting means includes spring means for resiliently urging said die rollers toward said backing rollers after said die rollers are less than a given distance from said backing rollers.

5. The apparatus of claim 1 wherein said drive means includes a drive shaft and means operatively coupling said rollers with said shaft in driving relation, said die rollers remaining coupled with said drive shaft in said inoperative open position.

6. The apparatus of claim 5 wherein said body comprises a tubular housing having a plurality of openings, said drive shaft extending longitudinally within said housing, said means operatively coupling said rollers to said shaft comprising worms on said drive shaft at said openings and worm gear means connected at least to some of said rollers for meshing with said worms.

7. The apparatus of claim 6 wherein said drive means further comprises a motor having an output shaft parallel to said drive shaft, a first sprocket connected to said output shaft, a second sprocket connected to said drive shaft and a chain operatively interconnecting said sprockets.

8. The apparatus of claim 6 wherein said pivotal mounting means comprises a pivotable housing connected to said tubular housing for pivotal movement about an axis concentric with said drive shaft, said die rollers and the associated worm gear means being movable with said pivotable housing between said operative and inoperative positions.

9. The apparatus of claim 8 comprising manually engageable means for pivotably moving said pivotable housing.

10. The apparatus of claim 1 wherein said actuator means comprises a lever, said first sensor means comprises a roller wheel mounted on said lever and said second sensor means comprises a bumper on said lever.

11. The apparatus of claim 10 wherein said lever has a front end, said bumper being mounted at said front end in forwardly projecting manner from said body, said roller wheel being rotatably mounted on said lever rearwards of said bumper.

12. The apparatus of claim 11 wherein said lever is provided with an elongated slot rearwards of said roller wheel, and said body includes a shaft slidably mounted in said slot such that when the roller wheel travels beyond the end of a seam the lever pivots and slides with respect to said shaft to become displaced with respect to said switch whereas when the bumper strikes an abutment the lever is also pivoted and undergoes sliding movement with respect to said shaft to become displaced with respect to said switch.

13. The apparatus of claim 1 wherein said drive means comprises a drive shaft rotatable about an axis of rotation and operatively coupled to those rollers which are to be driven in rotation, said die rollers being connected to said body by said pivotable mounting means for pivotal movement about said axis of rotation of said drive shaft.

14. The apparatus of claim 1 wherein said switch means comprises an electrical switch.

* * * * *